US005761828A

United States Patent [19]

Larson

[11] Patent Number: 5,761,828

[45] Date of Patent: Jun. 9, 1998

[54] IGNITION AND GAS FLOW CONTROL FOR CLOTHES DRYING MACHINE

[76] Inventor: Eric K. Larson, 42 King Philip Rd., Narragansett, R.I. 02882

[21] Appl. No.: 756,341

[22] Filed: Nov. 26, 1996

[51] Int. Cl.[6] ..... F26B 13/10

[52] U.S. Cl. ..... 34/531; 34/539; 34/551; 431/66

[58] Field of Search ..... 34/531, 539, 549, 34/551, 68, 86, 604, 606; 431/66, 67, 27, 70, 71; 432/22; 236/20 R

[56] References Cited

U.S. PATENT DOCUMENTS

| | | | |
|---|---|---|---|
| 3,614,074 | 10/1971 | Wellford, Jr. | 34/539 X |
| 3,806,308 | 4/1974 | Cahoe et al. | 432/44 |
| 3,933,419 | 1/1976 | Romanelli | 431/66 |
| 3,974,573 | 8/1976 | Daily et al. | 34/551 |
| 4,028,817 | 6/1977 | Winstel | 34/86 |
| 4,188,181 | 2/1980 | Rippelmeyer et al. | 431/66 |
| 4,226,026 | 10/1980 | Deming et al. | 34/445 |
| 4,402,663 | 9/1983 | Romanelli et al. | 431/66 |
| 4,506,458 | 3/1985 | Cochrane | 34/551 |
| 5,161,314 | 11/1992 | Souza | 34/551 X |

FOREIGN PATENT DOCUMENTS

| | | |
|---|---|---|
| 2209199 | 8/1990 | Japan . |

*Primary Examiner*—Henry A. Bennett
*Assistant Examiner*—Steve Gravini

[57] ABSTRACT

The gas flow and ignition of gas in a gas fired clothes dryer is controlled by coupling a soft ferrite material radiatively to an igniter element and non-radiatively to a heat sink. The temperature assumed by the ferrite material is above its curie point when the igniter element is hot enough to ignite the gas and below its curie temperature when the igniter is insufficient to ignite the gas. The change in the permeability of the ferrite material moves a magnet which controls the heating of the igniter element and the flow of gas.

1 Claim, 4 Drawing Sheets

IGNITION AND GAS FLOW CONTROL FOR CLOTHES DRYING MACHINE

BRIEF SUMMARY OF THE INVENTION

This invention relates to gas heated fabric drying machines and controlling the ignition of such machines and the like.

Gas fired clothes drying machines such as are used in household service typically are fired intermittently during the drying of a batch of clothes. This requires that the gas flow be restarted and ignited at the beginning of each burn period. The invention here described controls the gas flow and ignition is such a clothes dryer by coupling a soft ferrite material radiatively to an igniter element and non-radiatively to a heat sink. The temperature assumed by the ferrite material is above its curie point when the igniter element is hot enough to ignite the gas and below its curie temperature when the igniter is insufficient to ignite the gas. The change in the permeability of the ferrite material moves a magnet which controls the heating of the igniter element and the flow of gas.

DETAILED DESCRIPTION

Figure 1:
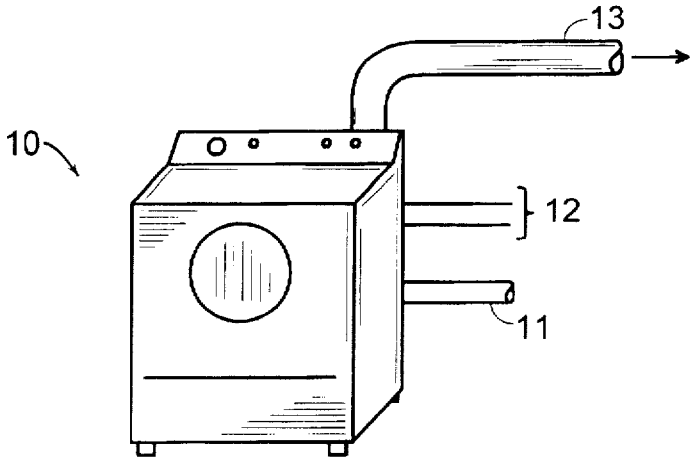
FIG. 1 shows a fabric drying machine according to the invention.

As shown in FIG. 1, fabric drying machine 10 according to the invention is supplied with combustible gas through pipe 11 and with electric power through conduit 12, and discharges water laden exhaust gases through vent 13.

Figure 2:
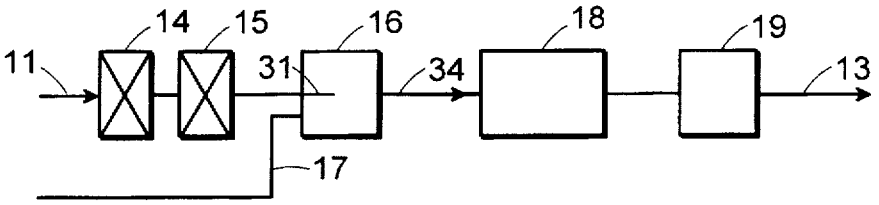
FIG. 2 shows schematically the paths of combustible gas and air through the drying machine of FIG. 1.

As shown particularly in FIG. 2, combustible gas passes from pipe 11 through valve 14 and valve 15 to gas nozzle 31 of burner 16. Ambient air is also admitted through air entry 17 to burner 16. From burner 16 a mix of air and combustion products pass through drying chamber 18 where water vapor is extracted from fabric being dried. The mixed gasses then pass to blower 19 which pulls the gasses through the system and delivers water laden exhaust to vent 13.

Figure 3:
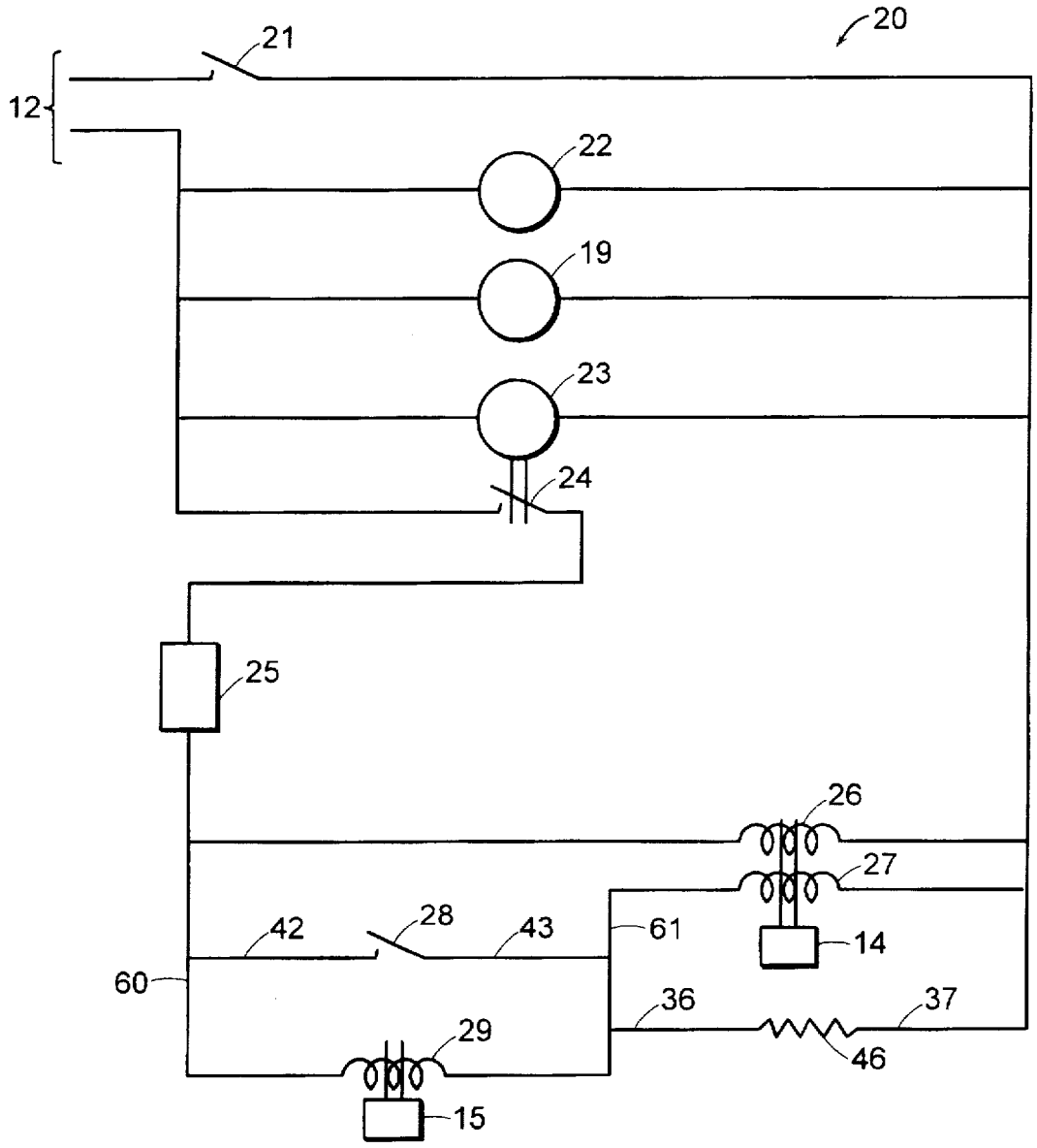
FIG. 3 shows schematically the principal electrical circuits of the drying machine of FIG. 1.

Electrical circuitry 20 controlling the operation of drying machine 10 is shown particularly in FIG. 3. It includes start switch 21 used by an operator to put the dryer in operation, drum motor 22 which agitates the drying chamber 18, timer 23 coupled mechanically to timer switch 24, and thermostat switch 25 controlled by a thermostat in the drying chamber 18. Further circuitry controlling the gas combustion include solenoid 26 (with a reactance of about 1400 ohms) and solenoid 27 (with a reactance of about 600 ohms), both of which are linked to valve 14 so that energizing both solenoids is required to move the valve from a closed to an open condition, but energizing of solenoid 26 alone is sufficient to hold valve 14 in an open condition. Circuitry further includes control switch 28, solenoid 29 (with a reactance about 1200 ohms) linked to open valve 15 when energized and an electric path 46 through igniter element 30, all connected as shown.

Figure 4:
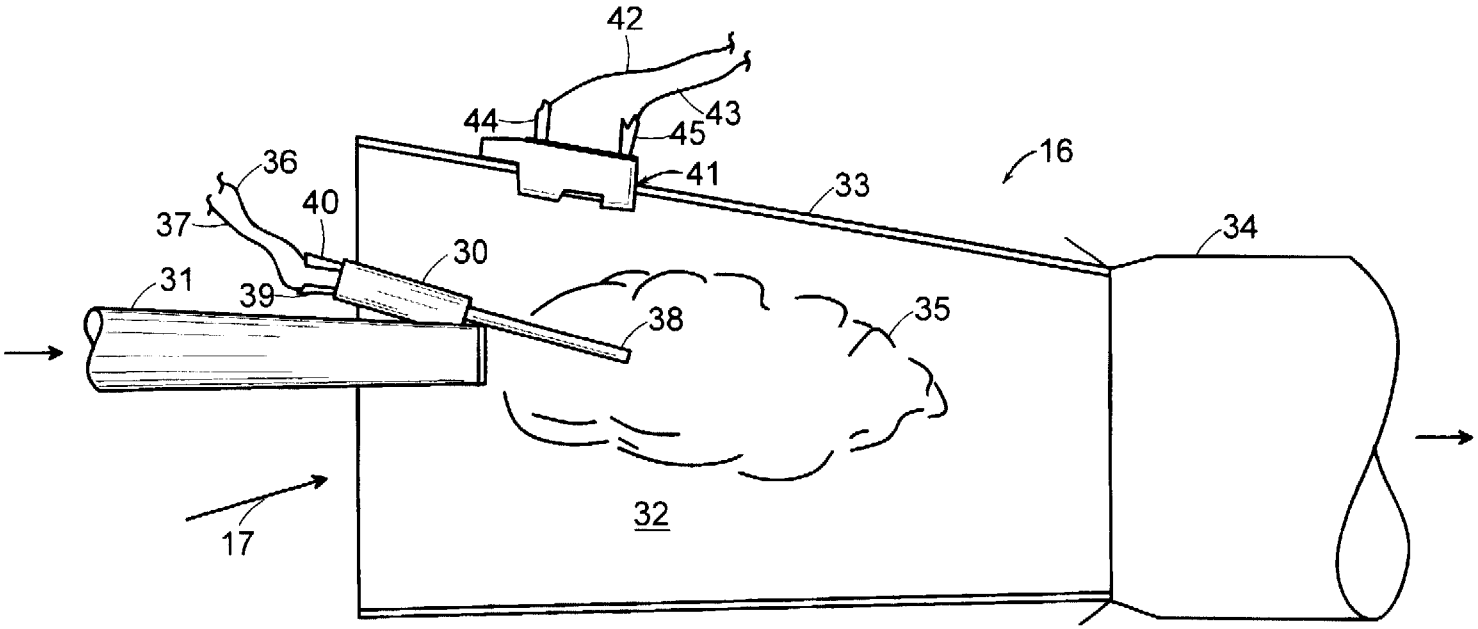
FIG. 4 shows in cross-section the gas burner assembly of the drying machine of FIG. 1.

Burner 16, as shown more particularly in FIG. 4, includes combustion chamber 32 within burner wall 33. Gas nozzle 31 ejects combustible gas into chamber 32 and air enters through entry 17. Duct 34 channels output gasses to drying chamber 18. When burner 16 is burning it holds a flame 35 which occupies a region within the burner.

Igniter element 30 provides a resistive electrical path 46 through silicon carbide between its terminals 39 and 40 which is connected by leads 36 and 37 to the circuitry shown in FIG. 3. It is commercially available. Igniter element 30 is affixed in burner 16 so that its heated portion 30 protrudes into the space occupied by flame 35.

Ignition condition sensor 41 is mounted in wall 33 of combustion chamber 32. Its terminals 44 and 45 are connected to the circuitry shown in FIG. 3 by leads 42 and 43.

Figure 5:
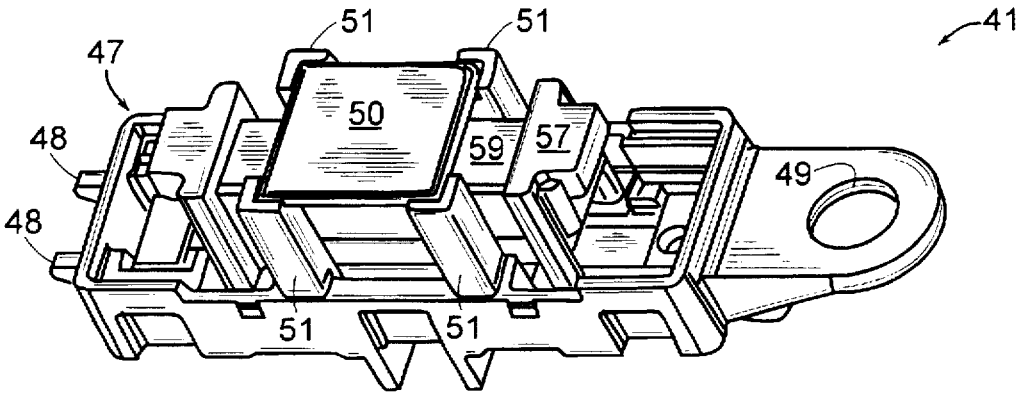
FIG. 5 shows a perspective view of an ignition condition sensor used in the fabric drying machine of FIG. 1 and shown in FIG. 4. The ignition condition sensor is shown with its cover removed.
Figure 6:
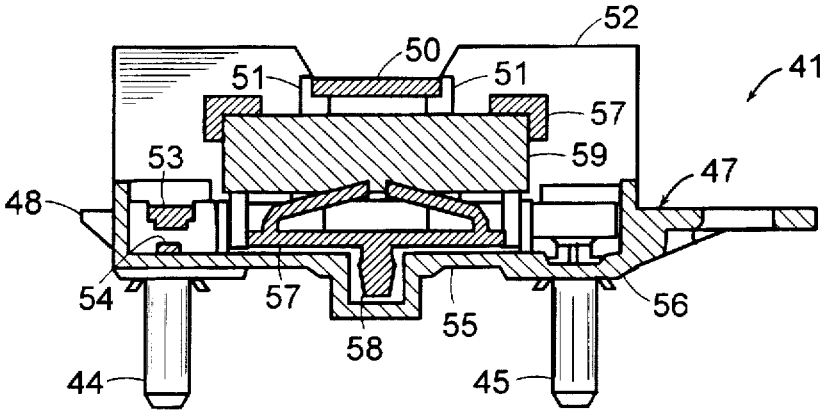
FIG. 6 shows in cross-section the ignition condition sensor shown in FIG. 4.

The construction of ignition condition sensor 41 is shown more particularly in FIGS. 5 and 6. Base 47 is made of molded polymeric material and is affixed to burner wall 33 by fingers 48 and screw hole 49. Base 47 supports pole piece 50 on four posts 51. Aluminum cover 52 has a window through which pole piece is exposed and is crimped to base 47 holding pole piece 50 in place against posts 51. Pole piece 50 has dimensions 1 cm×1 cm×0.1 cm and is made of a soft ferrite material formulated to have a curie temperature of 85 deg C. It is ferromagnetic when at a temperature below its curie temperature and not ferromagnetic when at a temperature above its curie temperature. A suitable pole piece is available from MMG North American, 126 Pennsylvania Av., Paterson, N.J. 07503 with reference to material number SCT-15BF-BF/85. Pole piece 50 is affixed through base 47 to wall 33 in a position 50 that pole piece 50 has a view of and is radiatively coupled to igniter element end 38 and is also exposed to and convectively coupled to air stream 17 which functions as a heat sink.

Terminal 44 is affixed to base 47 and electrically connected to contact point 53. Terminal 45 is affixed to base 47 and electrically connected to fixed end 56 of leaf spring 55, which is advantageously made of beryllium copper. Contact point 54 is affixed to the free end of leaf spring 55 opposite contact point 53. Leaf spring 55 is formed and affixed so that it urges contact point 54 away from contact point 53 and unless otherwise coerced leaves a gap between the contact points.

Magnet cradle 57 is attached to leaf spring 55 by knob 58 snapped through a hole in leaf spring 55 and is free to move up and down (as viewed in FIG. 6) with leaf spring 55. Permanent magnet 59 is captured in magnet cradle 57 and held thereby in position with a pole facing the inside face of pole piece 50. In the absence of a magnetic force between pole piece 50 and magnet 59 (as when pole piece is at a temperature above its curie temperature and not ferromagnetic) magnet cradle 57 and magnet 59 are pulled by spring 55 away from pole piece 50 leaving a gap between the magnet and the pole piece and a gap between contact points 53 and 54, thereby putting switch 28 in a non-conducting state. When pole piece 50 is at a temperature below its curie temperature and therefore ferromagnetic, magnetic force draws magnet 59 towards pole piece 50, overriding the urging of spring 55 and closing the gap between contact points 53 and 54, thereby putting switch 28 in a conductive state. Pole piece 50, permanent magnet 59, cradle 57, and spring 55 thus function as an actuation mechanism controlling the state of switch 28.

The operation of the clothes drying machine is as follows. Having loaded the drying chamber and selected a drying time, an operator initiates operation with the start switch 21. This sets the drum, blower, and timer going. Timer switch 24 remains closed for the duration of the drying period. Thermostat switch 25 closes when the dryer temperature is below a set temperature and open when the chamber is above a set temperature, producing alternating periods of heating and non-heating. Each time thermostat switch 25 is closed it initiates an ignition and burn cycle of the gas heater which continues until the the drying chamber rises above a set temperature and opens switch 25.

Immediately prior to the instant when an ignition and burn cycle is initiated, solenoid coils 26, 27, and 29 will be de-energized, valves 14 and 15 will be closed, no flame will be present in burner 16, igniter 30 will be at a temperature insufficient to effect ignition, pole piece 50 will be at a temperature below its curie temperature, magnet 59 will be pulled towards pole piece 50 and contact points 53 and 54 will be in contact, placing switch 28 in a conductive state. The conductive state of switch 28 is signaled by applying the potential of conductor 60 to conductor 61. Immediately after thermostat switch 25 closes, power is applied to solenoids 26 and 27 to open valve 14, and line voltage is applied across resistive path 46 in igniter 30. The resulting current through resistive path 46 heats igniter 30, which heats to a temperature above a minimum ignition temperature required to ignite the combustible gas. As the igniter heats it increasingly radiates energy to pole piece 50, which thereby is heated. When pole piece 50 heats to above its curie temperature, it ceases to be ferromagnetic and to attract magnet 59. Absent the attraction between magnet and pole piece, spring 57 pulls the magnet away from the pole piece and moves contact points 53 and 54 apart to put switch 28 in a non-conductive state. The non-conductive state of switch 28 is signaled by ceasing to apply the potential of conductor 60 to conductor 61. With the potential of conductor 60 no longer applied to conductor 61 by switch 28, current passes through solenoid 29 and resistance 46 in parallel with solenoid 27 to energize solenoid 29 and open valve 15, and power to solenoid 27 and to resistance 46 is reduced. Valve 14 is held open by solenoid 26, and gas is admitted to burner nozzle 31 and is ignited by contact with hot igniter element 30. The flame and structure heated thereby now radiate strongly enough to keep pole piece 50 at a temperature above its curie temperature. At this point the solenoids, valves, gas flow, flame, and radiation continue without change until power to the control circuitry is shut off by the rising temperature in the drying chamber opening switch 25. When switch 25 is opened, all solenoids are depowered, both valves are shut, the flame goes out, radiation from the flame and igniter diminishes, and the pole piece cools below its curie temperature switching switch 28 to its conductive state. Conditions remain so until the switch 25 initiates a new ignition and burn cycle.

The invention can be adapted to other circumstances to discriminate whether a radiating body such as the igniter element is at a temperature above a predefined temperature such as the minimum ignition temperature. In any circumstances the radiative coupling of the pole piece to the radiating body, the non-radiative coupling of the pole piece to some heat sink such as the gas stream in the detailed example, and the curie temperature of the pole piece are to be adjusted so that the temperature assumed by the pole piece rises above its curie temperature when the temperature of the radiating body rises above the predefined temperature. Methods for making calculations to achieve this adjustment in specific circumstances are well known to those skilled in the art of thermal engineering.

What is claimed is:

1. A fabric drying machine comprising a gas burner which when supplied with combustible gas and ignited holds a flame a blower for moving a stream of air past said burner and through a chamber holding fabric to be dried, an igniter element providing a resistive electrical path between electrical terminals, and being heated when electric current passes along said path, said igniter element being positioned to be heated by said flame and when hot to ignite combustible gas issuing from said gas burner, an ignition condition sensor controlling flow of gas to said burner, said ignition condition sensor comprising a switch with a first electrical terminal connected electrically to a first contact point and a second electrical terminal connected electrically to a second contact point, said first and second contact points being movable relative each other to put said switch in a first state in which said contact points are in contact and said first and second terminals are electrically connected or in a second state in which said first and second contact points are separated and said first and second terminals are electrically unconnected, the state of said switch determining whether gas is admitted to said burner or not, a permanent magnet connected mechanically to said second contact point, a pole piece connected mechanically to said first contact point and positioned within the magnetic field of said magnet a spring arranged and connected to provide a spring force urging said pole piece away from said magnet, said pole piece being made of material which has a curie temperature and is ferromagnetic when at a temperature below said curie temperature and not ferromagnetic when at a temperature above said curie temperature, said pole piece when below said curie temperature being attracted to said magnet with a force overcoming said spring force and moving said pole piece and said magnet together and when above said curie temperature being attracted to said magnet with a force less than said spring force so that said pole piece and said magnet move apart, said pole piece being positioned to be cooled convectively by said stream of air, and so that it is radiatively coupled to said igniter element and when said igniter is hot, is heated therefrom.

* * * * *